US005868860A

United States Patent [19]

Asplund

[11] Patent Number: 5,868,860

[45] Date of Patent: Feb. 9, 1999

[54] METHOD OF WASHING OBJECTS, SUCH AS TURBINE COMPRESSORS

[75] Inventor: Peter Asplund, Järfälla, Sweden

[73] Assignee: Gas Turbine Efficiency AB, Jarfalla, Sweden

[21] Appl. No.: 973,522

[22] PCT Filed: May 31, 1996

[86] PCT No.: PCT/SE96/00723

§ 371 Date: Dec. 5, 1997

§ 102(e) Date: Dec. 5, 1997

[87] PCT Pub. No.: WO96/40453

PCT Pub. Date: Dec. 19, 1996

[30] Foreign Application Priority Data

Jun. 7, 1995 [SE] Sweden ..... 9502079

[51] Int. Cl.[6] ..... B08B 3/02

[52] U.S. Cl. ..... 134/22.1; 134/22.18; 134/23; 134/32; 134/33

[58] Field of Search ..... 134/2, 22.1, 22.18, 134/23, 32, 33, 37; 60/39.53, 39.33; 415/116, 117

[56] References Cited

U.S. PATENT DOCUMENTS

| | | | |
|---|---|---|---|
| 3,623,668 | 11/1971 | Freid | 60/33.53 X |
| 4,196,020 | 4/1980 | Hornak et al. | 134/167 R |
| 4,377,420 | 3/1983 | Granatek et al. | 134/2 |
| 4,995,915 | 2/1991 | Sewell et al. | 134/22.1 X |
| 5,011,540 | 4/1991 | McDermott | 134/32 X |
| 5,193,976 | 3/1993 | Kolen et al. | 415/116 |
| 5,385,014 | 1/1995 | Rathbun | 134/22.1 X |

*Primary Examiner*—Jill Warden
*Assistant Examiner*—Saeed Chaudhry
*Attorney, Agent, or Firm*—Jacobson, Price, Holman & Stern, PLLC

[57] ABSTRACT

When washing objects, such as turbine compressors, which operate with large quantities of air and are therefore internally soiled by and coated with contaminants carried by the air, finely-divided liquid is sprayed onto and through the object. The liquid is finely-divided to a degree at which the particles of the liquid will follow the same routes to and through the object as those previously taken by the air-borne contaminants. The quantities of finely-divided liquid are sprayed through at least one nozzle toward and through the object at an overpressure within the range of 50–80 bars at a liquid particle size in the range 250–120 μm and with a total volumetric flow through the nozzle or nozzles within the range of 0.5–60 l/min., and with a liquid particle velocity of 100–126 m/sec.

2 Claims, 2 Drawing Sheets

METHOD OF WASHING OBJECTS, SUCH AS TURBINE COMPRESSORS

FIELD OF INVENTION

The present invention relates to a method for washing objects, such as turbine compressors, through which large volumes of air flow when said objects are at work and which therefore become soiled by and coated with contaminants carried in the air. This soiling of the objects can result in higher fuel consumption, higher temperatures and higher emissions with an associated general lowering in efficiency.

DESCRIPTION OF THE BACKGROUND ART

The soiling and coating of such objects by air-borne contaminants, e.g. as occurs in the operation of gas turbine compressors, results in diverse impairments and losses which, however, can be reduced at least partially by cleaning the compressor internally, ie by carrying out a so-called compressor wash. A large number of different types of washing systems are available to this end, a common factor of these systems being the consumption of large quantities of liquid, many of which liquids present a health hazard and are detrimental to the environment.

A conventional method of washing an aircraft engine for instance is to spray cold water into the engine through a hose having a diameter of about 2.5". This means that very large quantities of water are injected (300–400 l per engine) and has the following further drawbacks:

- The fan and compressor blades of the engine are placed under great strain.
- The engine start-up system is placed under great strain.
- The liquid is separated out by the centrifugal effect, resulting in a poor wash.
- Large quantities of liquid spill are occasioned around the aircraft.
- The method cannot be employed during cold year periods; and the wash gives a poor result, since the ability of water to wash away grease coatings is very limited (because of the large quantities of liquid required, the use of special washing liquids or detergents is uneconomical).

The object of the present invention is to eliminate the aforesaid and other drawbacks and to provide conditions for the lean use of resources and for obtaining an effective compressor wash, and to reduce the use of liquids that present a hazard to health and to the environment, and to enable turbine motors to be cleaned effectively with far less quantities of liquid while using an environmental-friendly liquid to this end.

BRIEF DESCRIPTION OF THE DRAWINGS

The invention will now be described in more detail with reference to the accompanying drawings, in which.

DETAILED DESCRIPTION OF THE INVENTION

The inventive method, is implemented by spraying small quantities of finely-divided liquid onto and through the object to be washed. The liquid is finely-divided to a degree such that when the liquid is sprayed against and through the object, the liquid particles will follow the same routes as those earlier taken by the air-borne contaminants through the object. Finely-divided liquid is sprayed onto and through the object in quantities corresponding to 0.5–60 l/min. and at an overpressure that lies in the range 50–80 bars with the liquid particle size (diameter) lying in the range of 250–120 $\mu$m(1 $\mu$m=$10^{-3}$ mm), and with particle velocities within the range of 100–126 m/sec., these values to be compared with corresponding values in present-day systems working with pressures of 3–10 bars, particle sizes of 150–950 $\mu$m and particle velocities in the range of 25–45 m/sec.

The novel method is thus based on a totally new principle. Because the liquid particles are given a size and velocity which together overcome the centrifugal effect, all accessible surfaces of the object will be cleaned effectively and efficiently.

The inventive object washing method, particularly when applied in "compressor washes" affords the following advantages, among others:

- Greater efficiency.
- Lower fuel consumption.
- Lower turbine inlet temperature.
- Reduced emissions.
- Shorter and "colder" start-up sequences.
- Less vibrations.
- Less corrosion.
- Reduced liquid quantities and fewer man hours involved in effecting a wash in accordance with the inventive method.

The reduction in the quantity of liquid required is advantageous, among other things because large quantities of water subject the turbine blades, for instance, to harmful mechanical loads.

Practical tests have shown that the liquid which best satisfies current environmental requirements in respect of "compressor washes" is the liquid retailed under the trade name R-MC, which is a surfactant that eats into and removes surface dirt.

Figure 1:
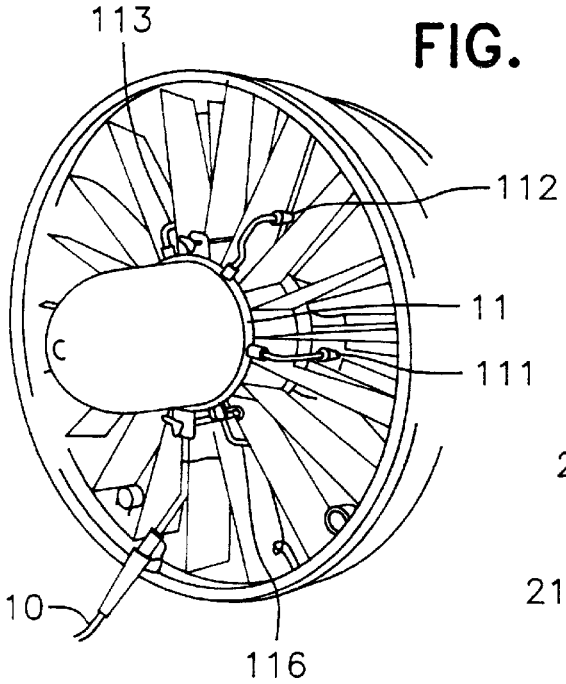
FIG. 1 illustrates washing of aircraft engines that include guide vanes.

FIG. 1 illustrates washing of aircraft engines equipped with guide vanes. A hose 10 is coupled to a ring feeder 11 having connected thereto six nozzles 111, 112, 113 . . . 116, with the nozzle openings directed into the engine. The hose is connected to a ground-supported water container (not shown), from which remote control of the water supply takes place.

Each nozzle is supplied with 0.1 litre of liquid per second for a time period of 30 seconds at a pressure of 70 bars. The size (diameter) of the liquid particles will be about 200 $\mu$m under these conditions.

Figure 2:
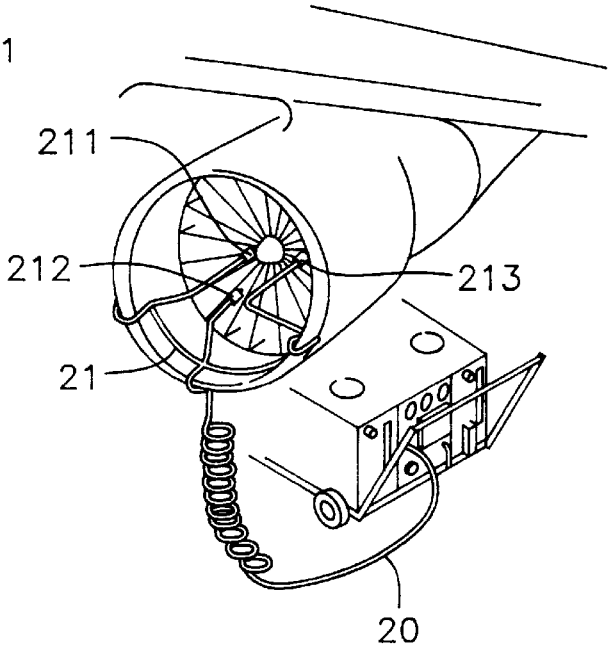
FIG. 2 illustrates washing of aircraft engines that do not include guide vanes.

FIG. 2 illustrates washing of an aircraft engine in which no guide vanes are fitted. A hose 20 is coupled to a feeder 21 to which three nozzles 211, 212, 213 are connected. The hose is connected to a ground-stationed service vehicle from which the washing procedure is controlled. Each nozzle is supplied with 0.05 litre of liquid per second over a time period of 20 seconds at a pressure of 60 bars. The liquid particles will have a size of about 120–150 $\mu$m under these conditions.

Figure 3:
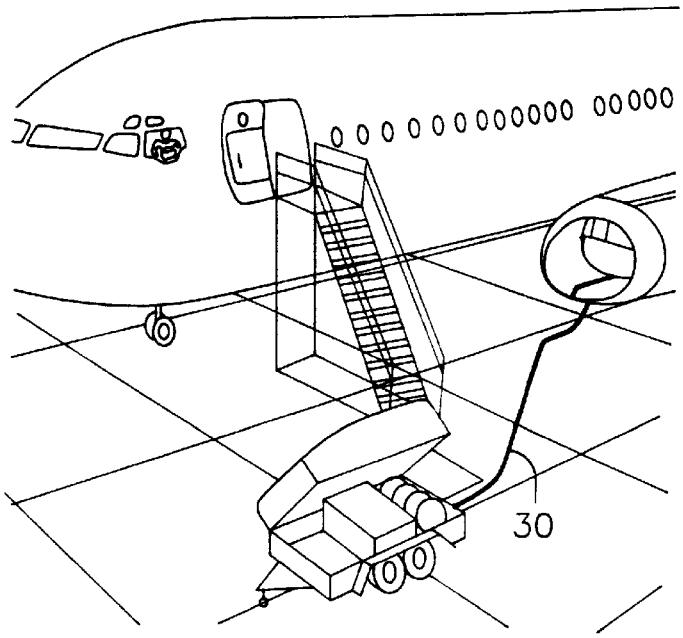
FIG. 3 illustrates a washing system that is controlled remotely from the aircraft cockpit.

FIG. 3 illustrates a washing system that is controlled remotely from the cockpit of an aircraft. The engine to be washed is shown to the right of the Figure. A hose 30 conducts water from the ground-stationed service unit to nozzles mounted in the engine. The entire washing procedure is controlled remotely from the aircraft cockpit.

The engine is running during the actual cleaning process, i.e. is rotated with the aid of its start motor, for instance; this provides the air flow that is needed for the finely-divided liquid particles to follow the same route as the air-borne particles and therewith reach dirt coatings throughout the engine.

Figure 4:
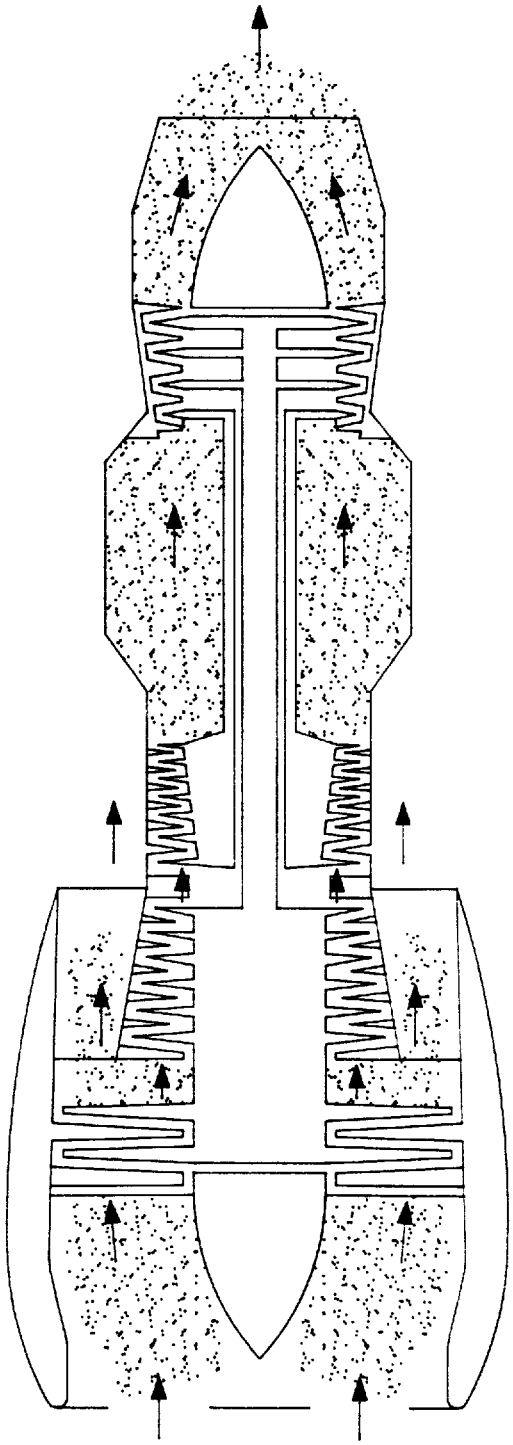
FIG. 4 illustrates paths or routes travelled by dirt particles/liquid droplets through a gas turbine engine.

FIG. 4 indicates in chain lines the route followed by the liquid particles through compressor, combustion chamber and turbine of a gas turbine engine.

The following variation ranges are suitable for achieving an appropriate particle size of 250–120 $\mu$m: pressure 50–80 bars, liquid flow rates 0.5–60 l/min., conveniently 2–60 l/min., and a particle velocity of 100–126 m/sec. When several nozzles are used in the spraying or injection process, the liquid volumetric flow applies for all nozzles together.

I claim:

1. A method of washing turbine compressors, which operate with large quantities of air and therefore become internally soiled by and coated with contaminants carried by the air, therewith giving rise to greater fuel consumption, higher temperatures and higher emissions with substantially impaired efficiency as a result thereof, wherein small quantities of finely-divided liquid are sprayed onto and through the turbine compressors, characterized by running the turbine compressors and spraying the finely-divided liquid quantities through at least one nozzle towards and through the turbine compressor at an overpressure within the range of 50–80 bars and at a liquid particle size in the range of 250–120 $\mu$m, and with a total volumetric flow through the nozzle or nozzles within the range of 0.5–60 l/min., and with a liquid particle velocity of 100–126 m/sec., whereby the liquid is finely-divided to a degree at which the particles of liquid will follow the same routes through the turbine compressor as those previously taken by the air-borne contaminants, when spraying said liquid onto and through said turbine compressor.

2. A method according to claim 1, characterized by using a total volumetric liquid flow within the range of 2–60 l/min.

* * * * *